US009416323B2

(12) United States Patent
Sahara et al.

(10) Patent No.: US 9,416,323 B2
(45) Date of Patent: Aug. 16, 2016

(54) PROCESS FOR PRODUCING LOW-SULFUR GAS OIL FRACTION, AND LOW-SULFUR GAS OIL

(75) Inventors: Wataru Sahara, Tokyo (JP); Kazuya Nasuno, Tokyo (JP); Tsukasa Kousaka, Tokyo (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 0 days.

(21) Appl. No.: 13/138,623

(22) PCT Filed: Mar. 11, 2010

(86) PCT No.: PCT/JP2010/001739

§ 371 (c)(1),
(2), (4) Date: Sep. 12, 2011

(87) PCT Pub. No.: WO2010/103838

PCT Pub. Date: Sep. 16, 2010

(65) Prior Publication Data

US 2012/0000823 A1 Jan. 5, 2012

(30) Foreign Application Priority Data

Mar. 13, 2009 (JP) ..... 2009-061626

(51) Int. Cl.

| | |
|---|---|
| ***C10G 45/72*** | (2006.01) |
| ***C10G 45/02*** | (2006.01) |
| ***C10G 45/08*** | (2006.01) |
| ***C10L 1/08*** | (2006.01) |

(52) U.S. Cl.

CPC ..... *C10G 45/72* (2013.01); *C10G 45/02* (2013.01); *C10G 45/08* (2013.01); *C10L 1/08* (2013.01); *C10G 2300/1059* (2013.01); *C10G 2300/202* (2013.01); *C10G 2300/301* (2013.01); *C10G 2300/304* (2013.01); *C10G 2300/307* (2013.01); *C10G 2300/4006* (2013.01); *C10G 2300/4018* (2013.01); *C10G 2300/80* (2013.01); *C10G 2400/06* (2013.01)

(58) Field of Classification Search

CPC ..... C10G 2300/1059; C10G 2300/202; C10G 2300/301; C10G 2300/304; C10G 2300/307; C10G 2300/4018; C10G 2300/80; C10G 2400/06; C10G 45/02; C10G 45/08; C10L 1/08

USPC ..... 208/46, 208 R, 209, 216 R, 217, 14, 15; 44/300

See application file for complete search history.

(56) References Cited

U.S. PATENT DOCUMENTS

| | | | | |
|---|---|---|---|---|
| 7,938,955 | B2 * | 5/2011 | Araki et al. | 208/216 R |
| 2007/0007177 | A1 | 1/2007 | Hunter et al. | |
| 2007/0205137 | A1 * | 9/2007 | Clark et al. | 208/17 |
| 2008/0155889 | A1 * | 7/2008 | O'Rear | 44/436 |

FOREIGN PATENT DOCUMENTS

| | | |
|---|---|---|
| CN | 1576352 | 2/2005 |
| CN | 1912063 | 2/2007 |
| EP | 1832645 A1 | 9/2007 |
| JP | 11-189776 | 7/1999 |
| JP | 2000-44968 | 2/2000 |
| JP | 2000-109860 | 4/2000 |
| JP | 2000-313891 | 11/2000 |
| JP | 2003-342587 | 12/2003 |
| JP | 2004-137353 | 5/2004 |
| JP | 2008-297437 | 12/2008 |

OTHER PUBLICATIONS

Furimsky, E, Selection of Catalysts and Reactors for Hydroprocessing, 1998, Applied Catalysis A: General, vol. 171, pp. 177-206.*

International Search Report dated Apr. 6, 2010 issued in corresponding PCT Application No. PCT/JP2010/001739.

Motoi Machida, "Hokozoku no Suisoka Tokusei Naphthalene Oyobi LCO no Suisoka Shori" Idemitsu Technical Report vol. 40, No. 4, 1997, pp. 347-353 (as cited in the International Search Report).

Chinese Office Action dated Jun. 5, 2013 issued in corresponding Chinese Application No. 201080011475.0. [With English Translation].

European Search Report issued on Nov. 11, 2015 in European Application No. 10750594.3.

* cited by examiner

*Primary Examiner* — Renee E Robinson
*Assistant Examiner* — Derek Mueller
(74) *Attorney, Agent, or Firm* — Kenyon & Kenyon LLP

(57) ABSTRACT

A process for producing a gas oil fraction by hydrodesulfurizing a feedstock oil prepared by blending a straight-run gas oil and a light cycle oil, wherein the process is capable of maintaining the activity of the desulfurization catalyst over a long period, and is capable of producing a low-sulfur gas oil fraction having a low sulfur content and excellent color index. The process for producing a low-sulfur gas oil fraction includes hydrodesulfurizing a feedstock oil to a sulfur content of not more than 10 ppm by mass, wherein the feedstock oil is prepared by blending a straight-run gas oil with a light cycle oil having a 10 volume % distillation temperature of less than 220° C. and a 90 volume % distillation temperature of less than 325° C., such that the blend proportion of the light cycle oil is not more than 30% by volume. Further, a low-sulfur gas oil is obtained by blending the low-sulfur gas oil fraction with a kerosene fraction.

9 Claims, No Drawings

PROCESS FOR PRODUCING LOW-SULFUR GAS OIL FRACTION, AND LOW-SULFUR GAS OIL

TECHNICAL FIELD

The present invention relates to a process for producing low-sulfur gas oil fraction, and low-sulfur gas oil.

This application is a national stage application of International Application No. PCT/JP2010/001739, filed 11 Mar. 2010, which claims priority to Japanese Patent Application No. 2009-061626, filed Mar. 13, 2009, the content of which is incorporated herein by reference.

BACKGROUND ART

Light cycle oil (LCO), which is a catalytically cracked gas oil produced by fluid catalytic cracking (FCC), contains large amounts of unstable olefins, and is therefore unsuitable as a gas oil fraction. Accordingly, there are limits to the potential uses of light cycle oil, although various attempts have been made to develop processes for effectively utilizing such light cycle oil.

For example, a process has been disclosed in which a blended oil containing a straight-run gas oil and a light cycle oil produced by FCC is used as a feedstock oil, and this feedstock oil is subjected to hydrodesulfurization in a gas oil desulfurization process using a hydrodesulfurization catalyst (hereinafter also referred to as a "desulfurization catalyst") (for example, see Patent Document 1).

On the other hand, in the case of gas oils used in diesel fuel and the like, the need to reduce environmental impact has seen a stepwise trend towards low-sulfur (or sulfur-free) oils with a reduced sulfur content. Conventionally, the regulated limit for the sulfur content has been 2,000 ppm by mass, and the sulfur content of the obtained gas oil fraction readily satisfies this prescribed limit even if a light cycle oil is used in the feedstock oil, since the sulfur content in the light cycle oil is 2,000 ppm by mass or less.

However, in recent years, the prescribed limit for the sulfur content in gas oil has been reduced to 10 ppm by mass, and therefore in order to enable a light cycle oil to be used in the above-mentioned feedstock oil, a higher level of hydrodesulfurization must be performed. One possible method for improving the sulfur content reduction effect of a hydrodesulfurization reaction using conventional technology would involve increasing the temperature of the hydrodesulfurization reaction. However, as the reaction temperature is increased, the rate of deactivation in the catalytic activity of the desulfurization catalyst increases markedly, resulting in a significant shortening in the life of the catalyst. Moreover, methods that involve increasing the reaction temperature tend to be accompanied by a deterioration in the color index of the obtained gas oil, making it very difficult to satisfy Japan's strict regulations (L1.5) relating to the color index of gas oils.

Accordingly, obtaining a gas oil fraction that exhibits favorable product properties such as sulfur content and color index using a method that involves increasing the reaction temperature of the hydrodesulfurization reaction is impossible without a significant accompanying reduction in the life of the desulfurization catalyst.

Further, some gas oil products are prepared by blending a gas oil fraction and a kerosene fraction, and in these cases it is important, from the viewpoint of the product combustibility, that the cetane index is a sufficiently high value.

CITATION LIST

Patent Document

Patent Document 1: Japanese Unexamined Patent Application, First Publication No. 2000-44968

DISCLOSURE OF INVENTION

Problems to be Solved by the Invention

An object of the present invention is to provide a process for producing a gas oil fraction by hydrodesulfurizing a feedstock oil prepared by blending a straight-run gas oil and a light cycle oil, wherein the process is capable of maintaining the activity of the desulfurization catalyst over a long period, and is capable of producing a low-sulfur gas oil fraction that satisfies the requirements for a sulfur content of not more than 10 ppm by mass and a color index of not more than L1.5. Further, another object of the invention is to provide a low-sulfur gas oil having a high cetane index by using the low-sulfur gas oil fraction obtained from the above production process.

Means for Solving the Problem

In order to achieve the above objects, the present invention adopts the aspects described below.

(1) A process for producing a low-sulfur gas oil fraction, the process including hydrodesulfurizing a feedstock oil to a sulfur content of not more than 10 ppm by mass, wherein the feedstock oil is prepared by blending a straight-run gas oil with a light cycle oil having a 10 volume % distillation temperature of less than 220° C. and a 90 volume % distillation temperature of less than 325° C., such that the blend proportion of the light cycle oil is not more than 30% by volume.

(2) A process for producing a low-sulfur gas oil fraction, the process including hydrodesulfurizing a feedstock oil to a sulfur content of not more than 10 ppm by mass, wherein the feedstock oil is prepared by blending a straight-run gas oil with a light cycle oil having a 10 volume % distillation temperature of not less than 165° C. but less than 220° C. and a 90 volume % distillation temperature of not less than 290° C. but less than 325° C., such that the blend proportion of the light cycle oil is not less than 2% by volume and not more than 30% by volume.

(3) The process for producing a low-sulfur gas oil fraction according to (1) or (2), wherein the hydrodesulfurizing of the feedstock oil is performed using a desulfurization catalyst containing at least one active metal selected from the group consisting of metals from group 6 of the periodic table and metals from groups 8 to 10 of the periodic table supported on an inorganic support containing an aluminum oxide, under conditions including a reaction temperature of 250 to 420° C., a hydrogen partial pressure of 2 to 10 MPa, a liquid hourly space velocity of 0.1 to 3 $h^{-1}$, and a hydrogen/oil ratio of 10 to 1,500 NL/L.

4) A low-sulfur gas oil fraction, produced using the process for producing a low-sulfur gas oil fraction according to any one of (1) to (3), and having a sulfur content of not more than 10 ppm by mass and a color index of not more than L1.5.

(5) A low-sulfur gas oil, prepared by blending the low-sulfur gas oil fraction according to (4) with a kerosene fraction, and having a cetane index of not less than 50, a cloud point of not more than 5° C., and a cold filter plugging point of not more than 5° C.

Advantageous Effects of the Invention

According to the production process of the present invention, a feedstock oil prepared by blending a straight-run gas oil and light cycle oil can be used to obtain a low-sulfur gas oil fraction that satisfies the requirements for sulfur content of not more than 10 ppm by mass and a color index of not more than L1.5, while maintaining the activity of the desulfurization catalyst over a long period. Further, the production process enables the light cycle oil to be utilized effectively, thereby improving economic viability.

Furthermore, the low-sulfur gas oil of the present invention uses the low-sulfur gas oil fraction mentioned above, and therefore is able to achieve a good cetane index with no accompanying increases in the cloud point and the cold filter plugging point.

BEST MODE FOR CARRYING OUT THE INVENTION (Process for Producing Low-Sulfur Gas Oil Fraction)

The process for producing a low-sulfur gas oil fraction according to the present invention is a process for hydrodesulfurizing a feedstock oil prepared by blending a straight-run gas oil with a light cycle oil (hereinafter also referred to as "the light cycle oil A") having a 10 volume % distillation temperature (hereinafter frequently abbreviated as "T10") of less than 220° C. and a 90 volume % distillation temperature (hereinafter frequently abbreviated as "T90") of less than 325° C.

Performing hydrodesulfurization enables the removal of sulfur compounds within the feedstock oil, thereby reducing the sulfur content. Examples of the removed sulfur compounds include organic sulfur compounds such as benzothiophenes, dibenzothiophenes, mercaptans, thioethers and dithioethers.

A straight-run gas oil is a gas oil fraction obtained by normal pressure distillation of a crude oil. There are no particular limitations on the straight-run gas oil, and the types of straight-run gas oils typically used in the production of gas oil fractions may be used.

Typical properties for the straight-run gas oil are listed below.

Boiling point: 150 to 400° C.

Density (15° C.): 0.8500 to 0.8700 g/cm$^3$

Sulfur content: 1.0 to 1.5% by mass

Aromatics content: 20 to 30% by volume

In this description, the density refers to the density measured at 15° C. in accordance with JIS K 2249 "Crude petroleum and petroleum products—Determination of density and petroleum measurement tables".

Further, the sulfur content refers to the sulfur content measured in accordance with "6. Radiation excitation method" prescribed in JIS K 2541-1992 "Crude oil and petroleum products—Determination of sulfur content".

Furthermore, the aromatics content refers to the total content of monocyclic, bicyclic and tricyclic aromatic compounds, measured in accordance with the HPLC method prescribed in JPI-5S-49-97.

The light cycle oil A is a catalytically cracked gas oil having T10<220° C. and T90<325° C. Further, in terms of better maintaining the activity of the desulfurization catalyst for a long period of time, and obtaining a low-sulfur gas oil fraction having a low sulfur content and a superior color index, the values of T10 and T90 for the light cycle oil A preferably satisfy 165° C.≤T10<220° C. and 290° C.≤T90<325° C., more preferably satisfy 170° C.≤T10<215° C. and 290° C.≤T90<320° C., and most preferably satisfy 180° C.≤T10<210° C. and 290° C.≤T90<315° C.

In this description, T10 and T90 refer to temperatures measured in accordance with JIS K 2254 "Petroleum products—Determination of distillation characteristics". T10 refers to the temperature at which 10% by volume of the gas oil fraction is removed by distillation (with a similar definition for T90).

The light cycle oil A can be obtained by catalytically cracking a reduced pressure gas oil or a heavy oil fraction such as a normal pressure residual oil, thereby converting the majority of the oil into a wide range of petroleum fractions, and subsequently recovering and distilling, from the catalytically cracked products, the gas oil fraction having a boiling point range of 150 to 400° C.

The sulfur content of the light cycle oil A immediately following preparation by the method described above is typically within a range from approximately 300 to 2,000 ppm by mass, and does not satisfy the sulfur content regulation of not more than 10 ppm by mass. Furthermore, the color index of the light cycle oil A is inferior to L1.5.

In this description, the color index refers to the color index measured in accordance with the ASTM color test method prescribed in JIS K 2580 "Petroleum products—Determination of color".

The inventors of the present invention conducted intensive investigation of processes that were capable of stably yielding a gas oil fraction having a favorable sulfur content and color index, while enabling the activity of the desulfurization catalyst to be maintained over a long period, thereby lengthening the catalyst life. As a result, they discovered that by using the light cycle oil A having T10<220° C. and T90<325° C. as the light cycle oil used within the feedstock oil, the rate of deactivation of the desulfurization catalyst could be reduced, and a gas oil fraction having a favorable sulfur content and color index could be produced without significantly shortening the life of the desulfurization catalyst.

Whereas a relatively heavy light cycle oil having a T90 value of 340° C. or 350° C. is used in conventional techniques, in the present invention, the much lighter light cycle oil A is used, and as a result, any reduction in the life of the catalyst is suppressed. It is thought that the reason the light cycle oil A of the present invention is able to better suppress the rate of deactivation in the desulfurization catalyst compared with conventionally used light cycle oils is because the concentration of tricyclic aromatic compounds within the light cycle oil A has been reduced.

The feedstock oil used in the present invention is a blended oil containing the above-mentioned straight-run gas oil and the light cycle oil A.

The amount of the light cycle oil A within the feedstock oil is not more than 30% by volume, and is preferably within a range from 2 to 30% by volume, more preferably from 3 to 27% by volume, and still more preferably from 5 to 25% by volume.

Provided the amount of the light cycle oil A is not more than 30% by volume, a low-sulfur gas oil fraction that satisfies the color index requirement of L1.5 can be obtained, and an amount of 27% by volume or less facilitates the production of a low-sulfur gas oil fraction having excellent color index properties. Further, provided the amount of the light cycle oil A is at least 2% by volume, the activity of the desulfurization catalyst can be more readily maintained for a long period under conditions that satisfy the requirements for a sulfur content of not more than 10 ppm by mass and a color index of L1.5.

In the production process of the present invention, the hydrodesulfurization catalyst (the desulfurization catalyst) is used to hydrodesulfurize the feedstock oil described above. There are no particular limitations on the reaction format employed for the hydrodesulfurization, which may be selected from among various formats including fixed beds and moving beds. A fixed bed is preferred. A conventional apparatus may be used as the gas oil desulfurization process used for performing the hydrodesulfurization.

The desulfurization catalyst used in the present invention may employ the types of catalysts typically used in the hydrodesulfurization of straight-run gas oils or light cycle-oils. Specific examples include desulfurization catalysts (hereinafter frequently referred to as "the desulfurization catalyst B") containing at least one active metal selected from the group consisting of metals from group 6 of the periodic table and metals from groups 8 to 10 of the periodic table. In this description, the periodic table refers to the long period type periodic table of elements prescribed by the International Union of Pure and Applied Chemistry (IUPAC).

Examples of preferred metals from group 6 of the periodic table include molybdenum, tungsten and chromium, and of these, molybdenum or tungsten is particularly preferred, and molybdenum is the most desirable.

Examples of preferred metals from groups 8 to 10 of the periodic table include iron, cobalt and nickel, and of these, cobalt or nickel is particularly preferred, and cobalt is the most desirable.

Any one of these metals may be used individually, or two or more metals may be used in combination.

In those cases where two or more metals selected from the group consisting of metals from group 6 of the periodic table and metals from groups 8 to 10 of the periodic table are used in combination as the active metal, preferred combinations include molybdenum-cobalt, molybdenum-nickel, tungsten-nickel, molybdenum-cobalt-nickel, and tungsten-cobalt-nickel.

In the desulfurization catalyst B, the active metal described above is preferably supported on an inorganic support containing an aluminum oxide.

Examples of the inorganic support containing an aluminum oxide include alumina, alumina-silica, alumina-boria, alumina-titania, alumina-zirconia, alumina-magnesia, alumina-silica-zirconia, alumina-silica-titania, and supports in which a porous inorganic compound such as one of the various clay minerals such as zeolites, sepiolite or montmorillonite is added to alumina. Of these possibilities, alumina is particularly preferred.

When supporting the above-mentioned active metal on the above-mentioned inorganic support, the amount of the metal from group 6 of the periodic table within the desulfurization catalyst B is preferably within a range from 10 to 30% by mass, based on the total mass of the catalyst. Further, the amount of the metal from groups 8 to 10 of the periodic table within the desulfurization catalyst B is preferably within a range from 1 to 7% by mass.

In those cases where a metal from group 6 of the periodic table is combined with a metal from groups 8 to 10 of the periodic table, the amounts of each metal within the desulfurization catalyst B preferably satisfy the respective ranges mentioned above.

The supporting of the active metal on the inorganic support can be achieved using a conventional method such as a dipping method, impregnation method or coprecipitation method using a solution, and preferably an aqueous solution, of a precursor to the active metal being supported. Further, following drying, the support having the precursor supported thereon is preferably calcined in the presence of oxygen to convert the active metal to an oxide. Moreover, performing a sulfidization treatment known as presulfiding to convert the active metal to a sulfide prior to performing the hydrodesulfurization of the feedstock oil is particularly desirable.

There are no particular limitations on the active metal precursor, and inorganic salts or organometallic compounds of the active metal may be used, although a water-soluble inorganic salt is preferred.

The hydrodesulfurization is performed so as to reduce the sulfur content in the product gas oil to not more than 10 ppm by mass. The sulfur content can be controlled by adjusting the reaction temperature during the hydrodesulfurization. Because the desulfurization catalyst B deactivates gradually as the hydrodesulfurization of the feedstock oil proceeds, the reaction temperature must be gradually increased to ensure the sulfur content of the product gas oil is held at a value of not more than 10 ppm by mass. In the method of the present invention, by using the light cycle oil A in the feedstock oil, the rate of deactivation of the desulfurization catalyst B can be reduced, meaning the hydrodesulfurization can be performed for long periods with minimal increase in the reaction temperature. Further, because the hydrodesulfurization can be performed without requiring an excessive increase in the reaction temperature, any deterioration in the color index of the product low-sulfur gas oil fraction can also be suppressed.

The sulfur content of the gas oil produced by the hydrodesulfinization reaction is preferably set within a range from 3 to 10 ppm by mass, and more preferably from 4 to 8 ppm by mass. Provided this setting for the sulfur content is at least 3 ppm by mass, obtaining a low-sulfur gas oil fraction with good suppression of any shortening of the life of the desulfurization catalyst is comparatively simple. Further, provided the setting for the sulfur content is not more than 10 ppm by mass, a low-sulfur gas oil fraction that satisfies the regulated limit for sulfur content within gas oils can be produced in a stable manner with comparative ease.

Although the reaction temperature during the hydrodesulfurization treatment varies depending on the gas oil desulfurization process used, the reaction temperature is preferably within a range from 250 to 420° C., more preferably from 260 to 415° C., and still more preferably from 270 to 410° C. Provided the reaction temperature is at least 250° C., the hydrodesulfurization reaction proceeds readily, and the productivity of the low-sulfur gas oil fraction improves. Further, provided the reaction temperature is not more than 420° C., the possibility of thermal decomposition reactions proceeding rapidly, causing decomposition of the gas oil fraction that results in a dramatic reduction in the yield, can be readily suppressed. Further, a low-sulfur gas oil fraction that satisfies the color index requirement of L1.5 can be more readily obtained.

The hydrogen partial pressure during the hydrodesulfurization treatment is preferably within a range from 2 to 10 MPa, more preferably from 2.5 to 9 MPA, and still more preferably from 3 to 8 MPa. Provided the hydrogen partial pressure is at least 2 MPa, rapid production of coke on the desulfurization catalyst B can be suppressed, enabling the life of the catalyst to be more readily extended. Further, provided the hydrogen partial pressure is not more than 10 MPa, a special-purpose gas oil desulfurization process is not required, which means construction costs for the reaction tower and the peripheral equipment can be reduced, thus improving the economic viability of the process.

The liquid hourly space velocity (LHSV) during the hydrodesulfurization treatment is preferably within a range from 0.1 to 3 $h^{-1}$, more preferably from 0.15 to 2.5 $h^{-1}$, and still more preferably from 0.2 to 2 $h^{-1}$. Provided the LHSV is at least 0.1 $h^{-1}$, a special-purpose gas oil desulfurization process is not required, which means construction costs for the reaction tower and the peripheral equipment can be reduced, thus improving economic viability. Further, provided the LHSV is not higher than 3 $h^{-1}$, the activity of the desulfurization catalyst B is more likely to manifest satisfactorily.

The hydrogen gas/oil ratio during the hydrodesulfurization treatment is preferably within a range from 10 to 1,500 NL/L, more preferably from 15 to 1,300 NL/L, and still more preferably from 20 to 1,100 NL/L. Provided the hydrogen gas/oil ratio is at least 10 NL/L, deactivation of the catalyst due to a reduction in the hydrogen concentration at the outlet of the reactor of the gas oil desulfurization process can be more readily controlled. Further, provided the hydrogen gas/oil ratio is not more than 1,500 NL/L, a special-purpose gas oil desulfurization process is not required, which means construction costs for the reaction tower and the peripheral equipment can be reduced, thus improving the economic viability of the process.

According to the production process of the present invention, a low-sulfur gas oil fraction having a sulfur content of not more than 10 ppm by mass and a color index that satisfies L1.5 can be produced in a stable manner, without any significant reduction in the life of the desulfurization catalyst B. With the present invention, the life of the desulfurization catalyst can be maintained for at least one year.

In this description, the life of the desulfurization catalyst refers to a value measured in the manner outlined below.

As deactivation of the catalyst progresses with ongoing operation of the hydrodesulfurization reaction, the reaction temperature is raised gradually while the reaction is continued in order to ensure that the sulfur content of the produced gas oil is not more than 10 ppm by mass. The point when the reaction temperature reaches a preset temperature limit is deemed to represent the end of the life of the desulfurization catalyst. The reaction is halted at that point, and the time period from the start of reaction through to the end of reaction is designated as the life of the desulfurization catalyst.

The preset temperature limit varies depending on the gas oil desulfurization process used for the hydrodesulfurization, but may be the temperature limit for ensuring that the product low-sulfur gas oil fraction satisfies the color index requirement of L1.5, or the reaction temperature limit for the gas oil desulfurization process used for the hydrodesulfurization.

By using the production process of the present invention described above, a feedstock oil prepared by blending a straight-run gas oil and the light cycle oil A can be used to produce a low-sulfur gas oil fraction that satisfies the requirements for a sulfur content of not more than 10 ppm by mass and a color index of L1.5, without any significant accompanying reduction in the life of the desulfurization catalyst.

Light cycle oil contains many sulfur compounds that are resistant to desulfurization and also includes other compounds besides sulfur compounds that can cause a loss in catalytic activity and/or a deterioration in product properties. Accordingly, stably obtaining a gas oil fraction with a sulfur content of not more than 10 ppm by mass using a light cycle oil has proven extremely difficult, but the present invention suppresses any significant reduction in the life of the desulfurization catalyst, and therefore has excellent economic viability.

(Low-Sulfur Gas Oil)

The low-sulfur gas oil of the present invention is a gas oil obtained by blending the low-sulfur gas oil fraction obtained from the production process described above with a kerosene fraction, and has a sulfur content of not more than 10 ppm by mass.

The sulfur content of the kerosene fraction is typically not more than 10 ppm by mass.

The density of the kerosene fraction at 15° C. is preferably within a range from 0.7500 to 0.8000 g/$cm^3$, more preferably from 0.7520 to 0.7980 g/$cm^3$, and still more preferably from 0.7540 to 0.7960 g/$cm^3$.

Further, the kerosene fraction preferably has a T10 value of 150 to 190° C. and a T95 value of 200 to 280° C., more preferably has a T10 value of 155 to 185° C. and a T95 value of 205 to 275° C., and still more preferably has a T10 value of 160 to 180° C. and a T95 value of 210 to 270° C.

The aromatics content in the kerosene fraction is preferably within a range from 10 to 30% by volume, more preferably from 12 to 28% by volume, and still more preferably from 14 to 26% by volume.

The amount of the low-sulfur gas oil fraction within the low-sulfur gas oil of the present invention is preferably within a range from 10 to 98% by volume, more preferably from 15 to 97% by volume, and still more preferably from 20 to 95% by volume. Provided the amount of the low-sulfur gas oil fraction is at least 10% by volume, the resulting low-sulfur gas oil exhibits favorable combustibility. Further, provided the amount of the low-sulfur gas oil fraction is not more than 98% by volume, the gas oil maintains favorable fluidity even under cold conditions.

The cetane index of the low-sulfur gas oil of the present invention is typically not less than 50, preferably not less than 50.5, and still more preferably 51.0 or greater. In this description, the cetane index is calculated in accordance with the method prescribed in JIS K 2280 "Petroleum products—Fuels—Determination of octane number, cetane number and calculation of cetane index".

Provided the cetane index of the low-sulfur gas oil is at least 50, the obtained low-sulfur gas oil exhibits excellent combustibility. In the present invention, by using the low-sulfur gas oil fraction obtained from the production process of the present invention described above, a low-sulfur gas oil having a cetane index of not less than 50 can be obtained.

Further, the cloud point (CP) of the low-sulfur gas oil is typically not more than 5° C., preferably not more than 4.5° C., and still more preferably 4° C. or lower. In this description, CP refers to the cloud point calculated in accordance with the method prescribed in JIS K 2269 "Testing methods for pour point and cloud point of crude oil and petroleum products".

Provided the CP value of the low-sulfur gas oil is not more than 5° C., any deterioration in the fluidity of the gas oil under cold conditions can be suppressed, and freezing of the gas oil can be inhibited.

Furthermore, the cold filter plugging point (CFPP) of the low-sulfur gas oil is typically not more than 5° C., preferably not more than 4° C., and still more preferably 3° C. or lower. In this description, CFPP refers to the cold filter plugging point calculated in accordance with the method prescribed in JIS K 2288 "Petroleum products—Diesel fuel—Determination of cold filter plugging point".

Provided the CFPP of the low-sulfur gas oil is not more than 5° C., the phenomenon wherein the gas oil can cause blocking of the fuel system under cold conditions can be inhibited.

The low-sulfur gas oil of the present invention described above provides a low-sulfur gas oil that exhibits a high cetane index, while suppressing any deterioration in the CP and CFPP values. It is thought that the reason for these superior properties is because the aromatics content within the light cycle oil A used in producing the low-sulfur gas oil fraction is lower than the aromatics content of conventionally used heavy catalytically cracked gas oils.

EXAMPLES

The present invention is described in more detail below based on a series of examples and comparative examples, but the present invention is in no way limited by these examples.

<Production of Low-Sulfur Gas Oil Fraction>

For the production of a low-sulfur gas oil fraction by hydrodesulfurizing a feedstock oil prepared by blending a straight-run gas oil shown in Table 1, obtained from a typical middle eastern crude oil (Arabian light crude), and a light cycle oil shown in Table 2, obtained from an FCC apparatus, the effect of the composition of the feedstock oil on the life of the catalyst and the color index of the resulting low-sulfur gas oil fraction were evaluated.

(Evaluation Methods)

(Life of Desulfurization Catalyst)

Evaluation of the life of the desulfurization catalyst was performed as described below.

The reaction temperature at the start of operation of the hydrodesulfurization of the feedstock oil (namely, the temperature inside the catalyst bed) was set to 350° C., and this temperature was gradually increased during reaction in order to maintain the sulfur content of the product oil at 10 ppm by mass. The point when the reaction temperature reached 380° C., which was set as the reaction temperature limit for the catalyst bed, was estimated to represent the end of the life of the desulfurization catalyst, and the desulfurization treatment was halted. The number of days from the start of operation through to the end of the desulfurization treatment was designated as the life of the catalyst.

(Color Index)

The color index of the obtained low-sulfur gas oil fraction was measured in accordance with the ASTM color test method prescribed in JIS K 2580 "Petroleum products—Determination of color".

(Preparation of Desulfurization Catalyst)

The incipient wetness method was used to prepare a desulfurization catalyst B1 by supporting molybdenum-cobalt as an active metal on an alumina support. The molybdenum content of the desulfurization catalyst B1 was 17% by mass, and the cobalt content was 4% by mass.

The desulfurization catalyst B1 was subjected to a presulfiding treatment prior to use. This presulfiding was performed by adding dimethyl disulfide (DMDS) to a sample of the feedstock oil used in each of the examples, in an amount equivalent to a sulfur content of 1% by mass, and then performing treatment for 24 hours under conditions including a hydrogen partial pressure of 5 MPa, an LHSV of 1 $h^{-1}$, and a reaction temperature of 300° C.

Example 1

A feedstock oil was prepared by blending a straight-run gas oil 1 shown in Table 1 and a light cycle oil 1 shown in Table 2 in a volume ratio of 90:10. Then, using the desulfurization catalyst B1 (volume used: 1 L), the feedstock oil was subjected to hydrodesulfurization, with the reaction temperature controlled so as to achieve a sulfur content within the product oil of 10 ppm by mass, thus yielding a gas oil fraction 1 (low-sulfur gas oil fraction).

The hydrogen partial pressure, LHSV and hydrogen/oil ratio during the hydrodesulfurization were as listed below.

Hydrogen partial pressure: 5 MPa

LHSV: 0.6 $h^{-1}$

Hydrogen/oil ratio: 200 NL/L

Example 2

With the exception of using a feedstock oil prepared by blending a straight-run gas oil 2 shown in Table 1 and a light cycle oil 2 shown in Table 2 in a volume ratio of 85:15, hydrodesulfurization was performed in the same manner as Example 1, yielding a gas oil fraction 2 (low-sulfur gas oil fraction).

Example 3

With the exception of using a feedstock oil prepared by blending a straight-run gas oil 3 shown in Table 1 and the light cycle oil 1 shown in Table 2 in a volume ratio of 80:20, hydrodesulfurization was performed in the same manner as Example 1, yielding a gas oil fraction 3 (low-sulfur gas oil fraction).

Comparative Example 1

With the exception of using a feedstock oil prepared by blending the straight-run gas oil 2 shown in Table 1 and a light cycle oil 3 shown in Table 2 in a volume ratio of 85:15, hydrodesulfurization was performed in the same manner as Example 1, yielding a gas oil fraction 4 (low-sulfur gas oil fraction).

Comparative Example 2

With the exception of using a feedstock oil prepared by blending the straight-run gas oil 1 shown in Table 1 and a light cycle oil 4 shown in Table 2 in a volume ratio of 90:10, hydrodesulfurization was performed in the same manner as Example 1, yielding a gas oil fraction 5 (low-sulfur gas oil fraction).

Comparative Example 3

With the exception of using a feedstock oil prepared by blending the straight-run gas oil 3 shown in Table 1 and the light cycle oil 1 shown in Table 2 in a volume ratio of 50:50, hydrodesulfurization was performed in the same manner as Example 1, yielding a gas oil fraction 6 (low-sulfur gas oil fraction).

The results of evaluating the life of the desulfurization catalyst and the color index of the obtained gas oil fraction in each of Examples 1 to 3 and Comparative Examples 1 to 3 are shown in Table 3.

TABLE 1

| | Straight-run gas oil 1 | Straight-run gas oil 2 | Straight-run gas oil 3 |
|---|---|---|---|
| Density (15° C.) [g/cm$^3$] | 0.855 | 0.854 | 0.852 |
| Sulfur content [% by mass] | 1.31 | 1.40 | 1.18 |
| T10 [° C.] | 271 | 268 | 264 |
| T90 [° C.] | 358 | 353 | 350 |
| Aromatics content [% by volume] | 27 | 25 | 28 |

TABLE 2

| | Light cycle oil 1 | Light cycle oil 2 | Light cycle oil 3 | Light cycle oil 4 |
|---|---|---|---|---|
| Density (15° C.) [g/cm$^3$] | 0.911 | 0.882 | 0.913 | 0.927 |
| Sulfur content [ppm by mass] | 1870 | 200 | 460 | 3200 |
| T10 [° C.] | 199 | 207 | 242 | 231 |
| T90 [° C.] | 308 | 311 | 345 | 356 |
| Aromatics content [% by volume] | 76 | 65 | 66 | 75 |

TABLE 3

| | Example | | | Comparative Example | | |
|---|---|---|---|---|---|---|
| | 1 | 2 | 3 | 1 | 2 | 3 |
| Straight-run gas oil 1 | 90 | — | — | — | 90 | 0 |
| Straight-run gas oil 2 | — | 85 | — | 85 | — | 0 |
| Straight-run gas oil 3 | — | — | 80 | — | — | 50 |
| Light cycle oil 1 | 10 | — | 20 | — | — | 50 |
| Light cycle oil 2 | — | 15 | — | — | — | — |
| Light cycle oil 3 | — | — | — | 15 | — | — |
| Light cycle oil 4 | — | — | — | — | 10 | — |
| Life of catalyst [years] | 2.5 | 3.8 | 3.1 | 0.5 | 0.8 | 1.9 |
| Color index of gas oil fraction | L1.0 | L1.0 | L1.0 | L1.5 | L1.5 | L2.0 |

As illustrated in Table 3, in Examples 1 to 3, which used the light cycle oil 1 or 2 that represents the light cycle oil A of the present invention, the life of the catalyst was 2.5 years or longer, confirming that deactivation of the desulfurization catalyst B1 was able to be suppressed for a long period. Further, the color index of the obtained gas oil fractions 1 to 3 were all L1.0, which satisfies the requirement for a color index of not more than L1.5.

In contrast, in Comparative Examples 1 and 2, which used the conventional light cycle oils 3 and 4 that were heavier than the light cycle oil A of the present invention, the life of the catalyst shortened dramatically to less than one year.

Further, in Comparative Example 3, which although using the light cycle oil 1 that represents the light cycle oil A of the present invention, had an overly high amount of the light cycle oil 1 in the feedstock oil, the color index of the resulting gas oil fraction 6 deteriorated significantly to L2.0.

<Production of Low-Sulfur Gas Oil>

Low-sulfur gas oils were prepared by blending each of the gas oil fractions obtained in Examples 1 to 3 and Comparative Examples 1 to 3 with a kerosene fraction, and the cetane index, CP (cloud point) and CFPP (cold filter plugging point) of each gas oil were evaluated.

(Evaluation Methods)

(Cetane Index)

The cetane index of the obtained low-sulfur gas oil was calculated in accordance with the method prescribed in JIS K 2280 "Petroleum products—Fuels—Determination of octane number, cetane number and calculation of cetane index".

(CP)

The CP of the obtained low-sulfur gas oil was calculated in accordance with the method prescribed in JIS K 2269 "Testing methods for pour point and cloud point of crude oil and petroleum products".

(CFPP)

The CFPP of the obtained low-sulfur gas oil was calculated in accordance with the method prescribed in JIS K 2288 "Petroleum products—Diesel fuel—Determination of cold filter plugging point".

(Kerosene Fraction)

The properties of the kerosene fraction 1 that was blended with each of the gas oil fractions obtained by hydrodesulfurization were as listed below.

Density (15° C.): 0.790 g/cm$^3$

T10: 167° C.

T95: 242° C.

Sulfur content: 6 ppm by mass

Aromatics content: 17.8% by volume

Examples 4 to 6

Low-sulfur gas oils were prepared by blending the gas oil fractions 1 to 3 obtained in Examples 1 to 3 with the above-mentioned kerosene fraction 1 in the volume ratios shown in Table 4.

Comparative Examples 4 to 6

Low-sulfur gas oils were prepared by blending the gas oil fractions 4 to 6 obtained in Comparative Examples 1 to 3 with the above-mentioned kerosene fraction 1 in the volume ratios shown in Table 4.

The results of measuring the cetane index, CP and CFPP for each of the low-sulfur gas oils obtained in Examples 4 to 6 and Comparative Examples 4 to 6 are shown in Table 4.

TABLE 4

| | Example | | | Comparative Example | | |
|---|---|---|---|---|---|---|
| | 4 | 5 | 6 | 4 | 5 | 6 |
| Gas oil fraction 1 | 70 | — | — | — | — | — |
| Gas oil fraction 2 | — | 95 | — | — | — | — |
| Gas oil fraction 3 | — | — | 25 | — | — | — |
| Gas oil fraction 4 | — | — | — | 70 | — | — |
| Gas oil fraction 5 | — | — | — | — | 95 | — |
| Gas oil fraction 6 | — | — | — | — | — | 25 |
| Kerosene fraction 1 | 30 | 5 | 75 | 30 | 5 | 75 |
| Cetane index | 56.7 | 54.0 | 51.2 | 48.0 | 47.1 | 48.2 |
| CP [° C.] | −5 | 3 | −10 | −3 | 8 | −14 |
| CFPP [° C.] | −4 | 2 | −9 | −2 | 9 | −14 |

As summarized in Table 4, the low-sulfur gas oils of Examples 4 to 6, which used the gas oil fractions 1 to 3 obtained using the production process of the present invention, exhibited favorable CP and CFPP values, and also had a high cetane index of not less than 50.

In contrast, in each of Comparative Examples 4 to 6, which used the gas oil fractions 4 to 6 obtained in Comparative Examples 1 to 3 in the same amounts as the gas oil fractions used in Examples 4 to 6, the cetane index was lower than the corresponding example, and the properties were inferior.

INDUSTRIAL APPLICABILITY

According to the production process of the present invention, a feedstock oil prepared by blending a straight-run gas oil and a light cycle oil can be used to obtain a low-sulfur gas oil fraction that satisfies the requirements for a sulfur content of not more than 10 ppm by mass and a color index of L1.5, while maintaining the activity of the desulfurization catalyst over a long period. Further, because the production process enables the effective utilization of light cycle oil and improves economic viability, the present invention is extremely useful from an industrial viewpoint.

The invention claimed is:

1. A process for producing a low-sulfur gas oil fraction, the process comprising:

preparing a feedstock oil including a straight-run gas oil and a light cycle oil having a 10 volume % distillation temperature of less than 220° C. and a 90 volume % distillation temperature of less than 325° C. by blending the straight-run gas oil with the light cycle oil such that the blend proportion of the light cycle oil is not more than 30% by volume and not less than 15% by volume; and hydrodesulfurizing the feedstock oil to obtain the low-sulfur gas oil fraction, wherein a sulfur content of the light cycle oil is within a range from 300 to 2,000 ppm by mass, wherein the hydrodesulfurizing of the feedstock oil is performed using a desulfurization catalyst comprising at least one active metal selected from the group consisting of metals from group 6 of the periodic table and metals from groups 8 to 10 of the periodic table supported on an inorganic support containing an aluminum oxide, wherein in the hydrodesulfurizing step, a reaction temperature is raised gradually while the hydrodesulfurization reaction is continued in order to ensure that a sulfur content of the low-sulfur gas oil fraction is not more than 10 ppm by mass, wherein a reaction temperature limit in the hydrodesulfurization is set to ensure that the low-sulfur gas oil fraction satisfies a color index requirement of L1.5, and wherein a life of the desulfurization catalyst is maintained for at least one year under hydrodesulfurizing of the feedstock oil.

2. The process for producing a low-sulfur gas oil fraction according to claim 1, wherein the hydrodesulfurizing of the feedstock oil is performed under conditions including a reaction temperature of 250 to 420° C., a hydrogen partial pressure of 2 to 10 MPa, a liquid hourly space velocity of 0.1 to 3 $h^{-1}$, and a hydrogen/oil ratio of 10 to 1,500 NL/L.

3. The process for producing a low-sulfur gas oil fraction according to claim 2, wherein an amount of the metal from group 6 of the periodic table in the desulfurization catalyst is within a range from 10 to 30% by mass based on a total mass of the desulfurization catalyst, and wherein an amount of the metal from groups 8 to 10 of the periodic table in the desulfurization catalyst is within a range from 1 to 7% by mass based on a total mass of the desulfurization catalyst.

4. The process for producing a low-sulfur gas oil fraction according to claim 1, wherein the life of the desulfurization catalyst exceeds 2.5 years.

5. The process for producing a low-sulfur gas oil fraction according to claim 2, wherein the reaction temperature is in a range of 350 to 420° C.

6. A process for producing a low-sulfur gas oil fraction, the process comprising:

preparing a feedstock oil including a straight-run gas oil and a light cycle oil having a 10 volume % distillation temperature of not less than 165° C. but less than 220° C. and a 90 volume % distillation temperature of not less than 290° C. but less than 325° C. by blending the straight-run gas oil with the light cycle oil such that the blend proportion of the light cycle oil is not more than 30% by volume and not less than 15% by volume; and hydrodesulfurizing the feedstock oil to obtain the low-sulfur gas oil fraction, wherein a sulfur content of the light cycle oil is within a range from 300 to 2,000 ppm by mass, wherein the hydrodesulfurizing of the feedstock oil is performed using a desulfurization catalyst comprising at least one active metal selected from the group consisting of metals from group 6 of the periodic table and metals from groups 8 to 10 of the periodic table supported on an inorganic support containing an aluminum oxide, wherein in the hydrodesulfurizing step, a reaction temperature is raised gradually while the hydrodesulfurization reaction is continued in order to ensure that a sulfur content of the low-sulfur gas oil fraction is not more than 10 ppm by mass, wherein a reaction temperature limit in the hydrodesulfurization is set to ensure that the low-sulfur gas oil fraction satisfies a color index requirement of L1.5, and wherein a life of the desulfurization catalyst is maintained for at least one year under hydrodesulfurizing of the feedstock oil.

7. The process for producing a low-sulfur gas oil fraction according to claim 6, wherein the hydrodesulfurizing of the feedstock oil is performed under conditions including a reaction temperature of 250 to 420° C., a hydrogen partial pressure of 2 to 10 MPa, a liquid hourly space velocity of 0.1 to 3 $h^{-1}$, and a hydrogen/oil ratio of 10 to 1,500 NL/L.

8. The process for producing a low-sulfur gas oil fraction according to claim 6, wherein the life of the desulfurization catalyst exceeds 2.5 years.

9. The process for producing a low-sulfur gas oil fraction according to claim 7, wherein the reaction temperature is in a range of 350 to 420° C.

* * * * *